United States Patent [19]

Tommaso

[11] 4,288,685

[45] Sep. 8, 1981

[54] FLOW-ACTIVATED RESISTANCE HEATER FOR WATER

[75] Inventor: Helio Tommaso, Atibaia, Brazil

[73] Assignee: Produtos Eletricos Corona Ltda., Brazil

[21] Appl. No.: 19,839

[22] Filed: Mar. 12, 1979

[51] Int. Cl.[3] ..... H05B 1/02; H01H 35/40; F24H 1/10

[52] U.S. Cl. ..... 219/309; 200/81.9 R; 200/83 J; 219/332; 219/496

[58] Field of Search ..... 219/308, 309, 496, 332, 219/296, 305–307; 200/81.9 R, 81.9 M, 81.9 HG, 83 J, 83 W, 83 T

[56] References Cited

U.S. PATENT DOCUMENTS

| | | | |
|---|---|---|---|
| 2,661,409 | 12/1953 | Lorenzetti | 200/81.9 R |
| 2,720,581 | 10/1955 | Lorenzetti | 219/309 |
| 2,734,106 | 2/1956 | Riley et al. | 200/81.9 R |
| 3,028,463 | 4/1962 | Birch | 200/81.9 R |
| 3,052,776 | 9/1962 | Schomann | 219/309 X |
| 3,226,505 | 12/1965 | Lucas et al. | 200/81.9 R |
| 3,531,622 | 9/1970 | Kaiser | 219/309 |
| 4,085,305 | 4/1978 | Dietz | 200/81.9 R |

FOREIGN PATENT DOCUMENTS

| | | | |
|---|---|---|---|
| 1188746 | 3/1965 | Fed. Rep. of Germany | 219/309 |
| 1276252 | 8/1968 | Fed. Rep. of Germany | 200/81.9 R |
| 666035 | 7/1964 | Italy | 219/309 |

*Primary Examiner*—A. Bartis

*Attorney, Agent, or Firm*—Blanchard, Flynn, Thiel, Boutell & Tanis

[57] ABSTRACT

A flow-activated water heater includes a body defining water inlet chamber communicating with a heating chamber containing an electric resistance heater through an intermediate flow duct. A movable piston supported by a flexible membrane and provided with a small flow-restricting opening separates the inlet chamber from the duct. A pair of fixed contacts disposed exteriorly of one side of the body are connected to the heater and a pair of movable contacts defined by substantially semi-circular conductive plates fixedly secured at one end relative to said body exteriorly encircle the flow duct with the other end thereof movable into and out of engagement with the fixed contacts. The other ends are also joined to an external carrier movable in the longitudinal direction of the duct. A pivotable lever mechanism exterds through the wall of the body and has its inner end connected to the membrane and its outer end connected to the carrier. The flow of water into the inlet chamber causes movement of the membrane which is transmitted through the lever and carrier cause the movable contacts to move into the engagement with the fixed contacts thereby energizing the heater to heat the water.

3 Claims, 4 Drawing Figures

FIG. 1
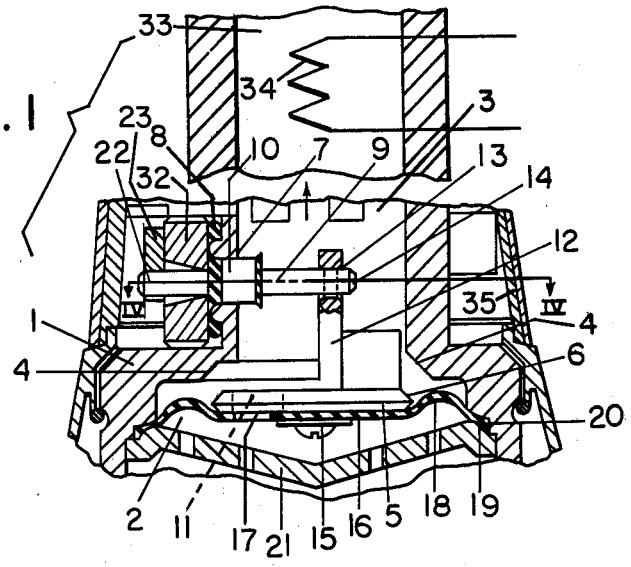
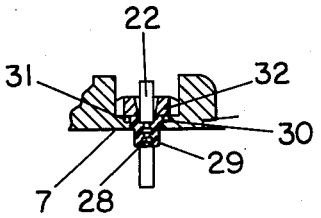
FIG. 2
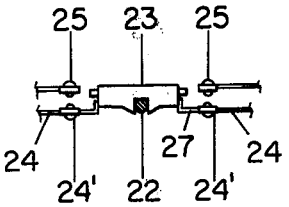
FIG. 3

FLOW-ACTIVATED RESISTANCE HEATER FOR WATER

The present invention refers to a new system of activating electric contacts in response to a hydraulic current, for connection to any kind of hydrothermoelectric apparatus, such as faucets, showers and electric heaters in general.

It consists essentially in the utilization of the hydraulic flow, in order to establish, with it, a mechanical impulse or force acting as the biasing force for a lever that extends to the exterior of the apparatus. This lever is connected to a driver, the subject of the present invention. The power of such impulse on the lever is multiplied according to the placement of its point of support, or to the relation of the lengths between the point of support and the driving extremity and the corresponding driven extremity, on which is connected the electrical contacts of the driver.

In this case, even with a reduced charge or impulse in the interior of the apparatus, as produced by the flow or current of the water, it will be possible to obtain a stronger charge outside for moving the electric contacts coupled to the lever.

The system presents an advantage over any other known system since it permits operating with any hydraulic current, of high pressure as well as of low pressure, while providing steadiness in the transmission of the hydraulic charge to the lever and consequently, security and reliability in the operation of the electrical contacts.

For better illustration of the subject of the present invention, I refer to the attached drawing:

FIG. 1 is a fragmentary transverse sectional view of the driver embodied in a heating apparatus;

FIG. 2 is a detailed view of the external extremity of the lever, and a proper sealing between the body and the lever;

FIG. 3 is a front view of the movable and fixed contacts and respective driving head.

DETAILED DESCRIPTION

Figure 4:
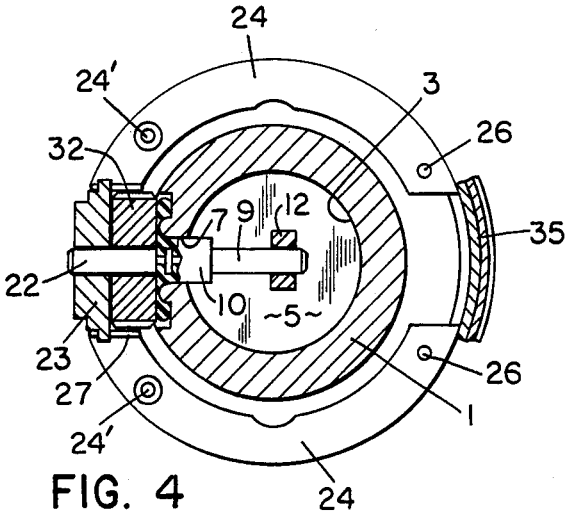
FIG. 4 is a top view of the movable laminated contacts.

The number 1 indicates the frame or body of a water supply apparatus such as a faucet, a shower or any heater. The interior of this body constitutes a combination of a receiving or inlet chamber 2 for the water, followed by a tubular intermediate cavity or duct 3 by which the water flows into the heating chamber 33 of the apparatus, in which heating chamber is placed the electric resistance 34 for heating the water. The receiving chamber 2 has a wall 4 that functions as a seat and support to limit the movement of a moving piston or plate 5 which has a peripheral edge 6 which is slightly inclined. In the wall defining the tubular cavity 3 there is a hole 7 through which, with a proper seal generally indicated by number 8, is supported a lever 9 which projects outside the body. The lever is pivotally supported on the cavity wall by an elastic bushing indicated by the number 10. The moving plate 5 is constituted by a disc having an interconnection hole 11 therethrough for the passage of the water from chamber 2 into cavity 3. The peripheral edge 6 of the plate coincides with and seats on wall 4, permitting a perfect seating. To the said plate 5 is incorporated a vertical projection 12 that has in its extremity a hole 13 for accommodating the inner extremity 14 of the lever 9. It is at this point that the lever receives its driving force or impulse. At the front face of the moving plate 5 is fixed, through a bolt 15 or by some other means, a flexible membrane 16 which also has an interconnection hole 17 that coincides with the plate hole 11. The membrane has a circular ring-shaped sector 18 with a bulged profile due to the edge of the membrane being clamped between a seat 20 disposed on the body and an apertured disc 21 conveniently fixed on the body 1.

The number 22 indicates the outer extremity of the lever 9 that is connected to an articulated carrier or head 23, which head 23 functions as a carrier and driver for the ends of the movable contacts 24. The contacts 24 are characterized by a planar semicircular configuration (see FIG. 4) which function as springs and which carry contact points 24' to which correspond the respective opposed fixed contacts 25.

I must explain that the movable contacts 24 correspond to those that will be connected to the distributing network (i.e., the power supply). The fixed contacts 25 will be connected to the electric resistance 34 which is associated with the apparatus for heating the water. The numbers 26 indicate the ends of the movable contacts 24 that are fixedly supported relative to the body 1 and are connected to the distributing network, and the numbers 27 define the other ends of the contacts 24 which are curved and connected to the movable head 23.

The articulated head 23 and contacts 24–25 are disposed in direct surrounding relationship to the tubular body part which defines the duct 3, as shown in FIGS. 1 and 4. These components are suitably enclosed by an annular shroud 35.

It must be pointed out that the lever 9 in the sector thereof placed in the outlet hole 7 has on part of its length threads indicated by the number 28. A bush 29 of elastic material surrounds the threads 28. This bush 29 has, at its outer end, an elastic membrane 30 in the shape of a disc with an enlarged peripheral body 31 that is seated in the hole 7 of the frame. The bush 29 is secured to the frame by a force fitting 32 and such ensemble forms the proper sealing means, indicated generally by the numbers 8 and 10 in FIG. 1.

OPERATION

The flow of water, upon entering the receiving chamber 2, comes into contact with the membrane 16 and the moving plate 5 which restricts its passage into cavity 3 whereby the plate 5 is moved until its edge 6 engages the seat 4. The movement of plate 5, and projection 12 thereon, causes a swinging movement of the lever 9 because its inner extremity 14 is positioned in the hole 13 of the projection 12. Consequently the other extremity 22 of the lever will have a large swinging movement, which movement is transmitted to the articulated head 23 to which are connected the movable contacts 24. Hence, these contacts 24 will be moved to complete the connection of the electric circuit with the fixed contacts 25 which are connected to the heating resistance. Through the respective holes 11 and 17 in the moving plate 5 and the flexible membrane 16, the water flows through the duct 3 to its utilization point, with the flowing water being heated by the energized electric resistance located within the interior of the apparatus.

With the stoppage of the water flow, a static fluid pressure equilibrium is established in the interior of the apparatus. Thus, the moving plate 5 moves back to its initial position by reason of the flexible membrane 16.

This return movement is helped by the pressure of the movable resilient contacts 24 which, due to their semicircular configuration, act as springs for displacing the head 23 and consequently the lever 9 and so helping it to return to its initial position. This causes the disconnection of the electric circuit.

In view of the ability of this apparatus to be activated by the impulse of the flow of water, the hydraulic flow may be started or interrupted at the inlet end as well as at the discharge end, since, in the absence of a pressure impulse, the moving plate stays in its closed position.

Thus, by the described apparatus, it may be seen that the system adopted for activating the contacts is really of great efficiency and absolute security in its working, even when the water flow is of low pressure. Further, the peculiar disposition adopted for the sealing in the passage of the lever to the outside of the body, ensures a perfect and safe sealing.

I claim:

1. In an apparatus for heating water including a hollow body through which a stream of water is permitted to flow, said body defining a heating chamber in which is positioned an electrical resistance heater, said body also having a receiving chamber therein for receiving the inflowing water and an intermediate duct for providing flow of water from said receiving chamber into said heating chamber, and activator means for energizing the resistance heater only in response to the flow of water into said receiving chamber, said activator means including piston means movably positioned within said body for effectively separating said receiving chamber from said intermediate duct, said piston means having small opening means associated therewith for restricting flow of water from said receiving chamber into said intermediate duct, said piston means being normally maintained in an inactive position under nonflow conditions and being moved a limited extent into an activated position in response to flow of water into said receiving chamber, electrical switching means positioned exteriorly of said body for selectively energizing or de-energizing said resistance heater, and lever-type link means operatively connected between said piston means and said switch means for activating said switch means to energize said heater when said piston means is moved into its activated position responsive to flow of water, said link means having a portion thereof projecting into said intermediate duct and operatively connected to said piston means, said link means projecting through the wall of said body and having a portion thereof projecting exteriorly of said body for operative cooperation with said switch means, the improvement wherein said body includes a tubular portion defining therein said intermediate duct, said switch means including a pair of stationary contacts disposed exteriorly of said tubular portion adjacent one side thereof, said switch means including a further pair of movable contacts disposed closely adjacent and in opposed relationship to said fixed contacts, said movable contacts being connected to and movable by a carrier which is movably supported adjacent the exterior of said tubular portion for movement in a direction substantially parallel with the axis of said tubular portion, said carrier being connected to the exteriorly projecting portion of said link means, said movable contacts being associated with a pair of substantially semicircular springlike conductive plates which are disposed in opposed relationship and substantially encircle the tubular portion, said carrier being connected between said springlike plates adjacent one end thereof and said movable contacts also being disposed adjacent said one end of said springlike plates, the other opposed ends of said springlike plates being fixedly positioned relative to said body and disposed relative to said tubular portion substantially diametrically opposite from said carrier, one said pair of contacts being electrically connected to said heater, and the other said pair of contacts being joined to a source of electrical energy.

2. A combination according to claim 1, wherein said lever-type link means includes a single elongated lever which projects substantially transversely through the wall of said tubular portion of said body, said lever having an intermediate portion thereof sealingly but pivotally supported on said body, said lever having an inner extremity thereof projecting into said intermediate duct and operatively connected to said piston means, said lever having an outer extremity thereof projecting outwardly from said tubular portion and operatively connected to said carrier for effecting movement thereof responsive to a corresponding movement of said piston means.

3. A combination according to claim 1, wherein said receiving chamber and said intermediate duct are substantially aligned with one another, said receiving chamber being of larger cross-section than said intermediate duct whereby said tubular portion defines an interior annular seat located substantially at the interface between the receiving chamber and said intermediate duct, said piston means being engageable with said seat when in said activated position, said piston means including a substantially annular plate-like piston positioned in coaxial alignment with the inlet end of said intermediate duct and disposed for engaging said seat, said plate-like piston having a projection fixed thereto and projecting axially therefrom into said intermediate duct, said link means having said portion thereof which projects into said intermediate duct being operatively connected to said projection, said piston means also including a diaphragm fixed to said platelike piston and extending across said receiving chamber in the vicinity of said seat, the outer peripheral edge of said diaphragm being fixedly secured relative to said body, and said small opening means as associated with said piston means extending through both said diaphragm and said platelike piston along a direction substantially parallel with the longitudinal direction of said intermediate duct.

* * * * *